US007686083B1

(12) United States Patent
Emfinger

(10) Patent No.: US 7,686,083 B1
(45) Date of Patent: Mar. 30, 2010

(54) METHOD AND APPARATUS FOR CUTTING OFF A WELL

(76) Inventor: Dwayne Emfinger, P.O. Box 116, McKittrick, CA (US) 92351

( * ) Notice: Subject to any disclaimer, the term of this patent is extended or adjusted under 35 U.S.C. 154(b) by 0 days.

(21) Appl. No.: 12/231,124

(22) Filed: Aug. 28, 2008

Related U.S. Application Data

(60) Provisional application No. 60/967,160, filed on Aug. 31, 2007.

(51) Int. Cl.
*E21B 35/00* (2006.01)
*E21B 29/00* (2006.01)

(52) U.S. Cl. ..... 166/298; 166/55; 166/79.1

(58) Field of Classification Search ..... 166/55, 166/55.6, 79.1, 135, 298, 316, 363, 364, 166/376; 81/57.39
See application file for complete search history.

(56) References Cited

U.S. PATENT DOCUMENTS 4,703,802 A 11/1987 Bryan et al.
5,146,989 A 9/1992 Rouse
5,158,138 A * 10/1992 DeCuir, Sr. ..... 166/95.1
5,238,069 A 8/1993 Schaefer, Jr.
5,318,115 A 6/1994 Rouse
5,597,041 A * 1/1997 Robinson ..... 166/55
6,330,919 B1 12/2001 McGarian
6,554,073 B2 4/2003 McGarian
6,827,145 B2 * 12/2004 Fotland et al. ..... 166/298
7,090,019 B2 8/2006 Barrow et al.
2002/0060076 A1 5/2002 Harrell

* cited by examiner

*Primary Examiner*—David J Bagnell
*Assistant Examiner*—Michael Wills, III
(74) *Attorney, Agent, or Firm*—Sandy Lipkin

(57) ABSTRACT

A method and apparatus for cutting off a well which includes hydraulic rams, a sharp blade and a supporting structure that surrounds the well and holds it in place while the hydraulic rams and sharp beveled blade shears the well and cuts it off. The entire apparatus is operated with an hydraulic system and can be lifted over any well with a crane.

16 Claims, 6 Drawing Sheets

METHOD AND APPARATUS FOR CUTTING OFF A WELL

REFERENCE TO PRIOR APPLICATION

This application claims the priority of provisional application 60/967,160, filed Aug. 31, 2007 entitled MEANS FOR CUTTING OFF A WELL by Dwayne Emfinger.

BACKGROUND OF THE INVENTION

1. Field of the Invention

The present invention relates generally to the field of oil well maintenance and specifically to a means of cutting off a well whose productivity has come to an end.

2. Description of the Prior Art

Wells for the drilling of oil have a life. Once the life of the well is over, it is plugged with cement. These wells are formed of concentric circles that are plugged with cement when they are retired. When a well is plugged, it normally involves cutting off of the upper part of the casing string that is not fully cemented and pulling it out of the hole for salvage. Flammable gasses are emitted from these wells, even after their usefulness has expired. Prior art ways of cutting off wells have involved a large fire hazard, using hot torches to perform the task. The instant invention seeks to overcome this shortcoming and provide a safe, effective means for cutting off a well.

SUMMARY OF THE INVENTION

The preferred embodiment of the present invention teaches an apparatus for cutting off a well comprising a substantially rectangular shaped base, the base further comprising a front face; a rear face; a first side face; a second side face wherein the front face, the rear face, the first side face and the second side face combine to create an interior space that is to be placed around a well to be cut off; a first pair of vertical supports attached to the front face; a second pair of vertical supports attached to the rear face wherein the first pair of vertical supports and the second pair of vertical supports are connected through a first supporting side bar and a second supporting sidebar; a third pair of vertical supports extending from the first side face and second side face at a position substantially midway across the first side face and the second side face; a first supporting bar connecting the second pair of vertical supports; a second supporting bar connecting the third pair of vertical supports; a ramming member extending from the first supporting side bar wherein the ramming member is connected to the first supporting side bar at its proximate end and wherein the ramming member's distal end terminates in a u-shaped member; one or more hydraulic rams attached to the rear face; a blade attached to the one or more hydraulic rams; and a recessed portion attached to the front face into which the blade is moved through the one or more hydraulic rams.

The above embodiment can be further modified by defining that the first side face and the second side face contains one or more horizontal slots that sit substantially parallel to each other.

The above embodiment can be further modified by defining that the second pair of vertical supports contains apertures to aid in the movement thereof with a crane.

The above embodiment can be further modified by defining that the third pair of vertical supports contains apertures to aid in the movement thereof with a crane.

The above embodiment can be further modified by defining that the ramming member is connected to hydraulic lines.

The above embodiment can be further modified by defining that the one or more hydraulic rams are connected to hydraulic lines.

The above embodiment can be further modified by defining that the blade has one or more beveled steps.

The above embodiment can be further modified by defining that the recessed portion is substantially u-shaped.

An alternate embodiment of instant invention teaches a method for cutting off a well comprising locating a defunct well; placement of an apparatus around the defunct well, the apparatus further comprising a substantially rectangular shaped base, the base further comprising a front face; a rear face; a first side face; a second side face wherein the front face, the rear face, the first side face and the second side face combine to create an interior space that is to be placed around a well to be cut off; a first pair of vertical supports attached to the front face; a second pair of vertical supports attached to the rear face wherein the first pair of vertical supports and the second pair of vertical supports are connected through a first supporting side bar and a second supporting sidebar; a third pair of vertical supports extending from the first side face and second side face at a position substantially midway across the first side face and the second side face; a first supporting bar connecting the second pair of vertical supports; a second supporting bar connecting the third pair of vertical supports; a ramming member extending from the first supporting side bar wherein the ramming member is connected to the first supporting side bar at its proximate end and wherein the ramming member's distal end terminates in a u-shaped member; one or more hydraulic rams attached to the rear face; a blade attached to the one or more hydraulic rams; and a recessed portion attached to the front face into which the blade is moved through the one or more hydraulic rams; causing the one or more hydraulic rams and the ramming member to be moved from the rear face to the front face so that the well is held in place by the recessed portion and the ramming member while said blade cuts off the well; and removing the well.

The above embodiment can be further modified by defining that the first side face and the second side face contains one or more horizontal slots that sit substantially parallel to each other.

The above embodiment can be further modified by defining that the second pair of vertical supports contains apertures to aid in the movement thereof with a crane.

The above embodiment can be further modified by defining that the third pair of vertical supports contains apertures to aid in the movement thereof with a crane.

The above embodiment can be further modified by defining that the ramming member is connected to hydraulic lines.

The above embodiment can be further modified by defining that the one or more hydraulic rams are connected to hydraulic lines.

The above embodiment can be further modified by defining that the blade has one or more beveled steps.

The above embodiment can be further modified by defining that the recessed portion is substantially u-shaped.

DETAILED DESCRIPTION OF A PREFERRED EMBODIMENT

Figure 1:
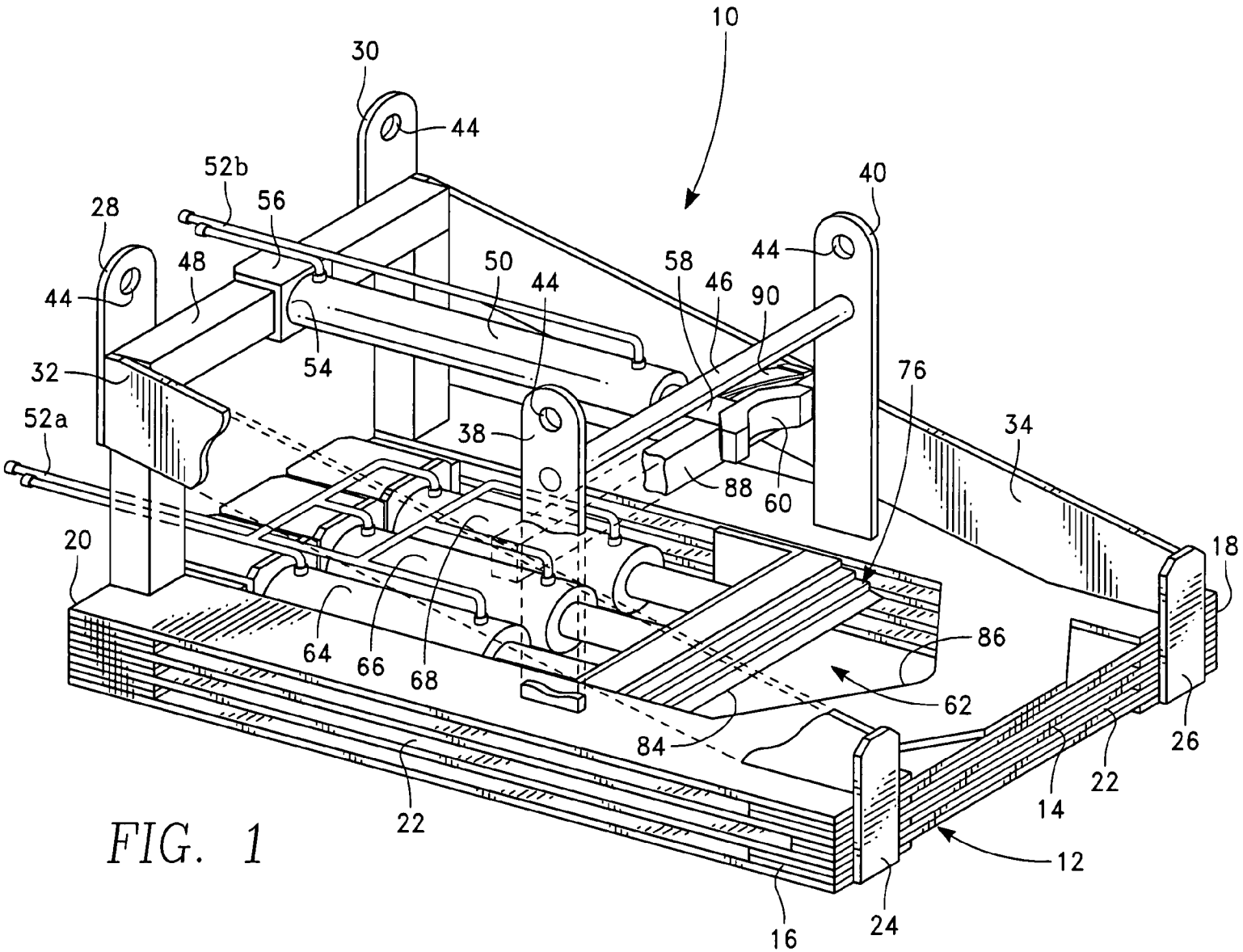
FIG. 1 is an isometric view of the entire apparatus and system of the instant invention.
Figure 2:
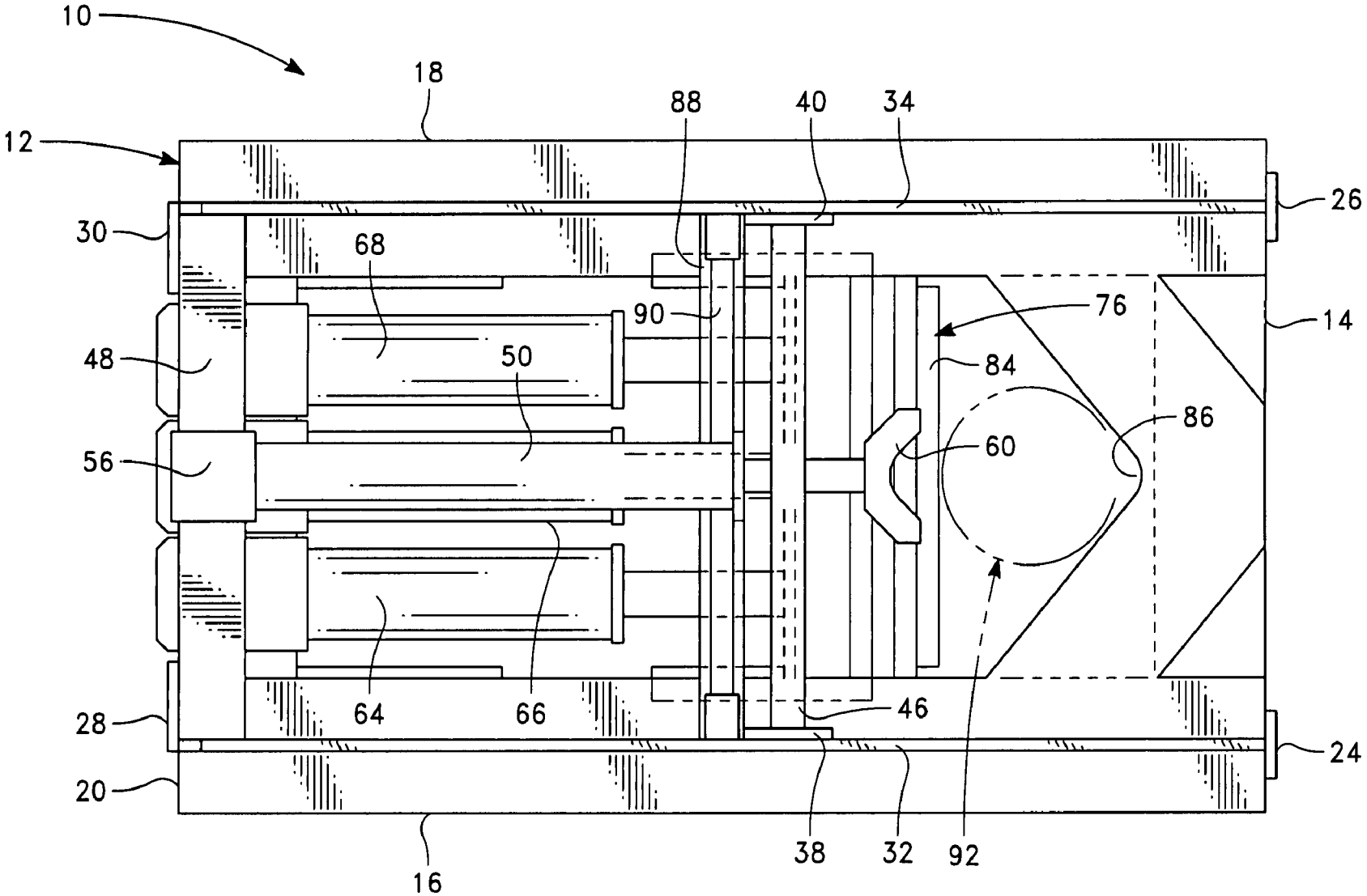
FIG. 2 is a top view of the entire apparatus and system of the instant invention.
Figure 3:
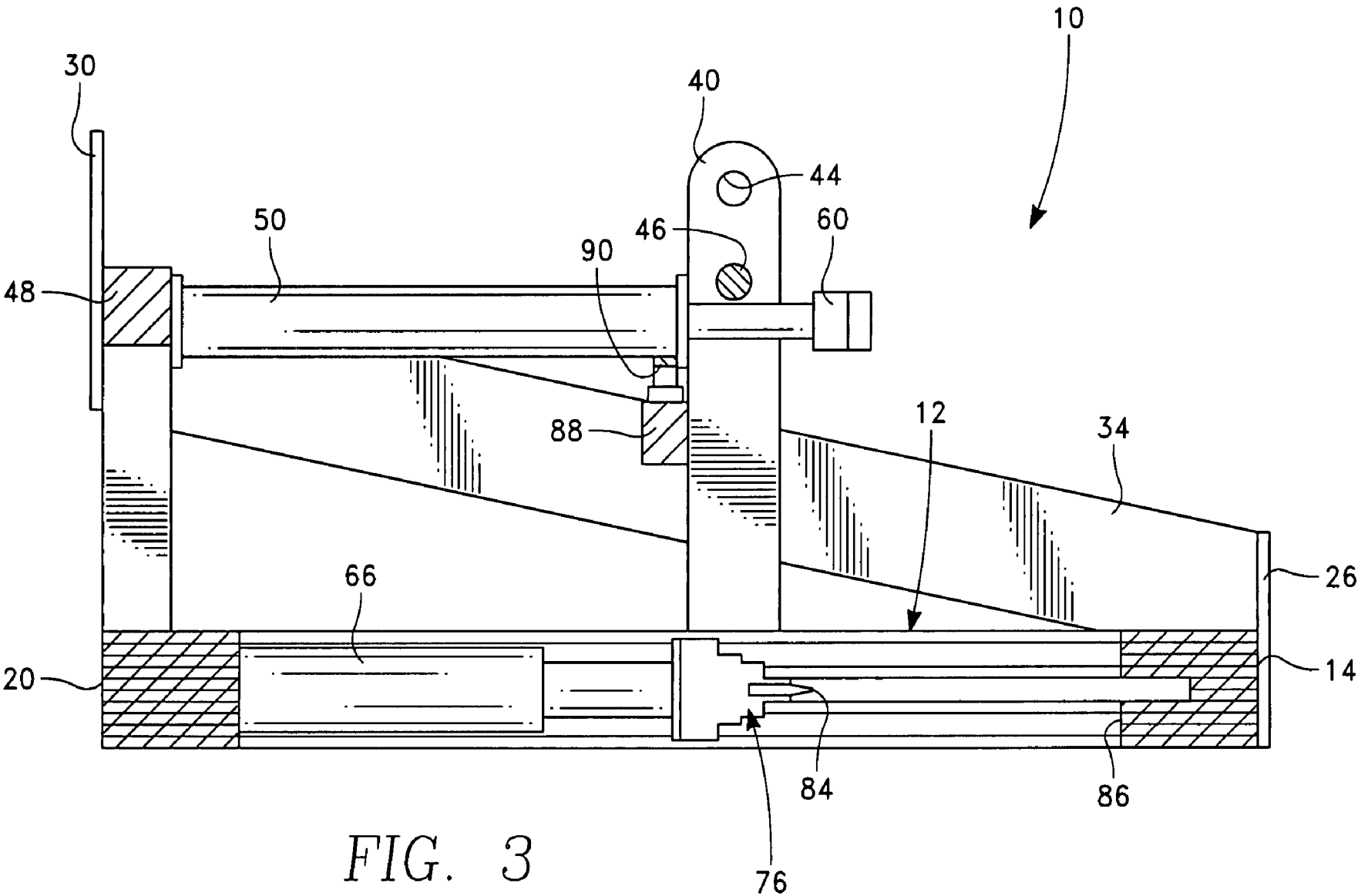
FIG. 3 is a side view of the apparatus of the instant invention.

Turning to the drawings, the preferred embodiment is illustrated and described by reference characters that denote similar elements throughout the several views of the instant invention.

The preferred embodiment refers to an apparatus and method for cutting off a well without the use of torches. The invention is a large apparatus that can be seen in the attached drawings. The device is basically a large pair of shears that uses plow steel wire rope and hydraulic rams that use enough force to cut the rebar of the well.

The following is a list of reference numerals for ease of navigating through the drawings:

| | |
|---|---|
| 10 | apparatus |
| 12 | base |
| 14 | front face |
| 16 | first side face |
| 18 | second side face |
| 20 | rear face |
| 22 | slots |
| 24 | first front vertical support |
| 26 | second front vertical support |
| 28 | first rear vertical support |
| 30 | second rear vertical support |
| 32 | first supporting side bar |
| 34 | second supporting side bar |
| 38 | first middle vertical support |
| 40 | second middle vertical support |
| 44 | apertures |
| 46 | middle supporting bar |
| 48 | rear supporting bar |
| 50 | ramming member |
| 52a | hydraulic lines connected to the bottom hydraulic rams |
| 52b | hydraulic lines connected to the ramming member |
| 54 | proximate end of ramming member |
| 56 | sleeve |
| 58 | distal end of ramming member |
| 60 | u-shaped member |
| 62 | interior space |
| 64 | first bottom hydraulic ram |
| 66 | second bottom hydraulic ram |
| 68 | third bottom hydraulic ram |
| 70 | distal end of first bottom hydraulic ram |
| 72 | distal end of second bottom hydraulic ram |
| 74 | distal end of third bottom hydraulic ram |
| 76 | blade |
| 78 | first beveled step |
| 80 | second beveled step |
| 82 | third beveled step |
| 84 | fourth beveled step |
| 86 | u-shaped recessed portion |
| 88 | beam |
| 90 | leaf spring |
| 92 | well |
| 94 | hydraulic system |
| 96 | straps |

The apparatus 10 of the instant invention is an integral unit that is hoisted in place through a crane. The apparatus 10 is placed around a well that is ready to cut off. The apparatus 10 has a generally rectangular shaped base 12, having a front face 14, a first side face 16, a second side face 18 and a rear face 20. The front face 14 and side faces 16, 18 are not solid. Rather, they are comprised of a series of slots 22 through which the interior machinery of the apparatus moves when in use.

On the front face 14 is situated a pair of vertical supports 24, 26. Likewise, the rear face 20 contains its own pair of vertical supports 28, 30. The vertical supports 28, 30 on the rear face 20 are substantially taller than the vertical supports 24, 26 on the front face 14. Two supporting side bars 32, 34 are attached to the vertical supports 24, 26 on the front face 14 and extend at an angle to the vertical supports 28, 30 on the rear face 20 and are connected thereto.

Two additional vertical supports 38, 40 are situated approximately midway between the vertical supports 24, 26 on the front face 14 and the vertical supports 28, 30 on the rear face 20. These two additional supports 38, 40 are connected to the supporting side bars 32, 34 which extend between the front face 14 and the rear face 20 vertical supports 24, 26, 28, 30. Included on the vertical supports 28, 30 of the rear face 20 and the intermediate vertical supports 38, 40 are apertures 44 that allow for the entire apparatus 10 to be lifted and moved by a crane (not shown). A supporting bar 46 connects the intermediate vertical supports 38, 40. Similarly, a supporting bar 48 extends between the vertical supports 28, 30 of the rear face 20.

Figure 4:
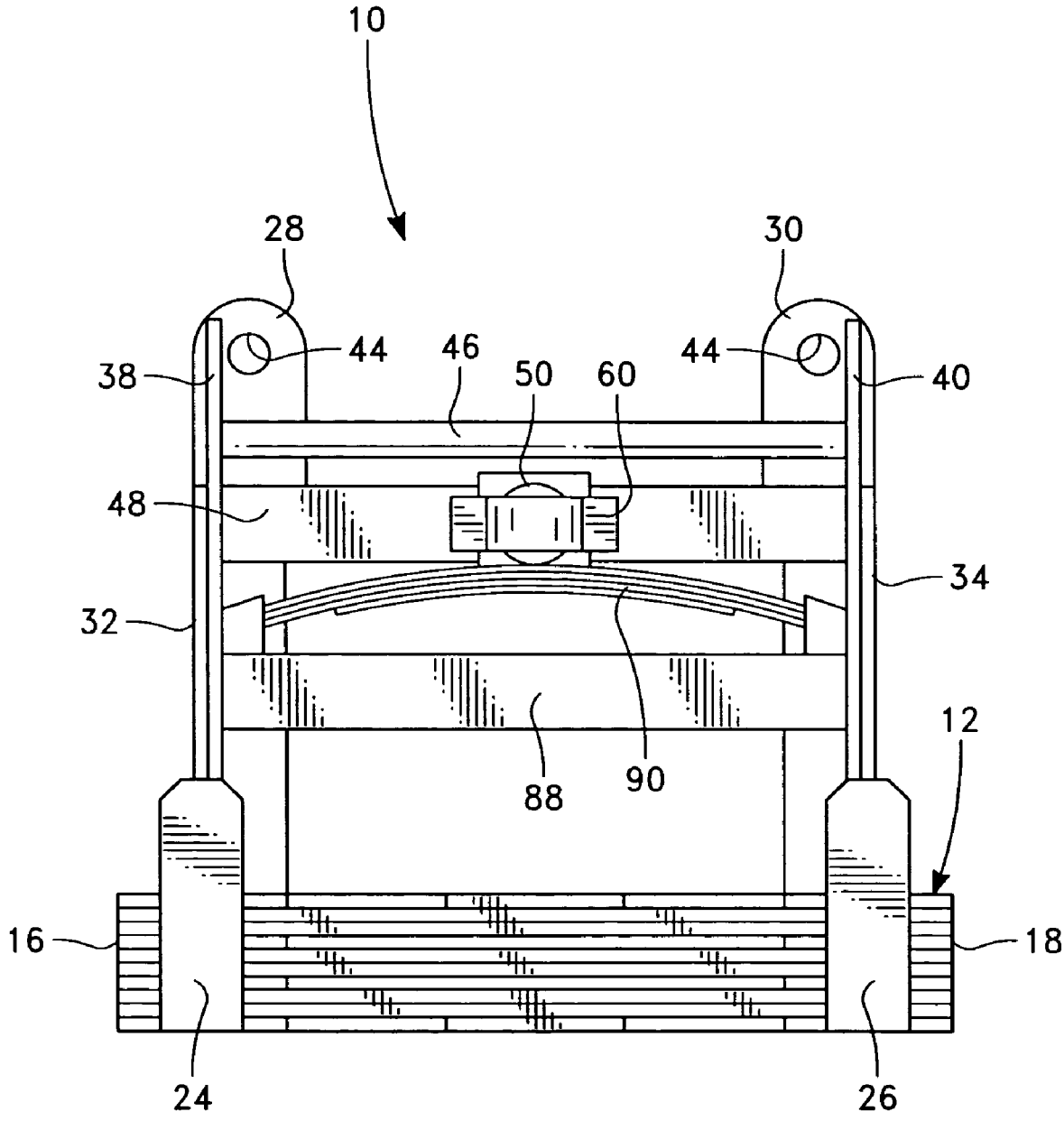
FIG. 4 is a front view of the apparatus of the instant invention.
Figure 5:
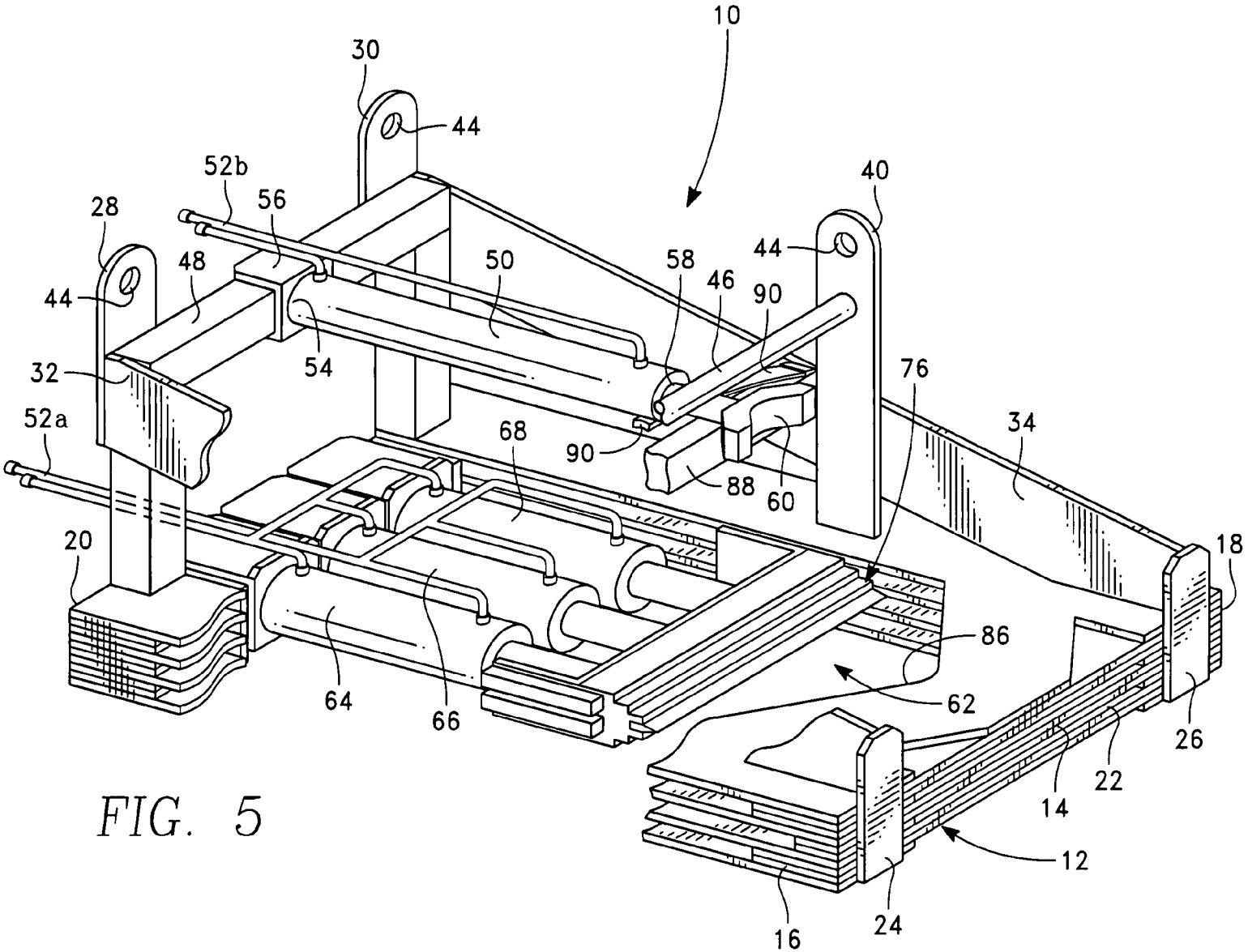
FIG. 5 is an isometric view of the apparatus of the instant invention with one of the side bars cut out.

The supporting bar 48 between the rear vertical supports 28, 30 supports a ramming member 50 that is connected to the supporting bar 48 and is connected through hydraulic lines 52 to an air compressor (not shown). The proximate end 54 is connected to the supporting bar 48 through a sleeve 56 while the distal end 58 attaches to a substantially u-shaped member 60. The ramming member 50 is supported (seen clearly in FIG. 4) by a beam 88 that extends from the middle vertical supports 38, 40 that has connected above it, a leaf spring 90.

Between the four walls 14, 16, 18, 20 of the base 12 is an interior space 62. This interior space 62 houses the cutting mechanism of the apparatus 10. Attached to the rear face 20 of the base, as shown in the illustrations, are three hydraulic rams 64, 66, 68. Each hydraulic ram 64, 66, 68 is connected to an air compressor (not shown). Each hydraulic ram 64, 66, 68 is connected at their distal ends 70, 72, 74 from the air compressor to a blade 76 that in the illustration includes four beveled layers 78, 80, 82, 84. The blade 76, when the apparatus 10 is in operation, travels through grooves 22 on the rear walls 16, 18 of the base 12.

Attached to the front face 14 of the base is a substantially u-shaped 86, recessed portion. The interior space 62 between the blade 76 and the u-shaped recessed portion 86 is to be placed over the well that is to be cut off.

Figure 6:
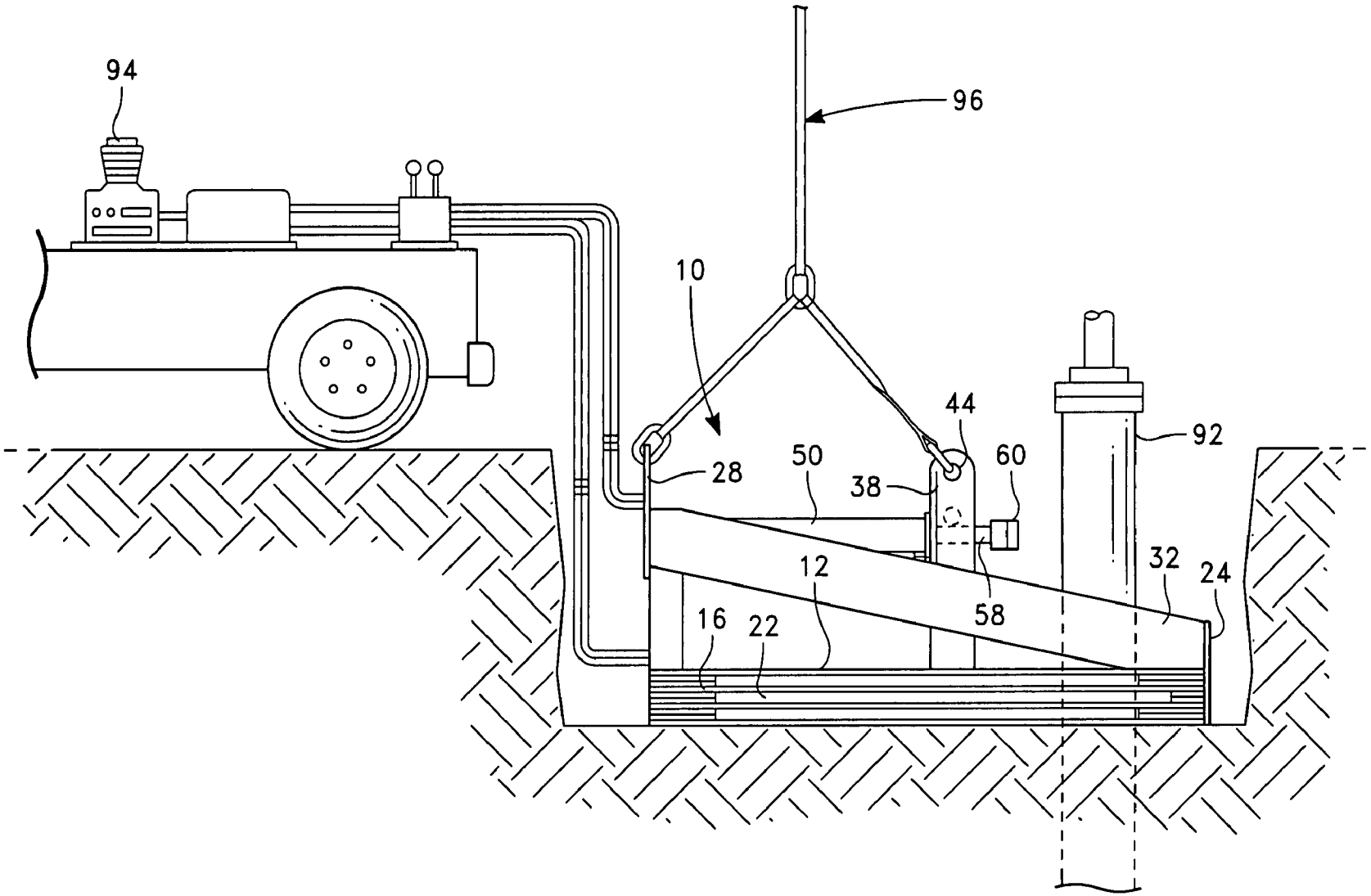
FIG. 6 is a side view of the invention in use.

In use (see FIG. 6), the apparatus 10 is lifted by a crane (not shown) via straps 96 through the apertures 44 located on the rear vertical supports 28, 30 and the intermediate vertical supports 38, 40. The apparatus is positioned over a well 92 that is to be cut off. The interior space 62 is positioned over the well 92 and the entire apparatus 10 is lowered by the crane so that the well sits in the interior space.

The top ramming member 50 and the bottom hydraulic rams 64, 66, 68 are connected through lines 52*b*, 52*a*, respectively, to an hydraulic system 94. Once connected to the hydraulic system 94, the ramming member and the bottom hydraulic rams 64, 66, 68 move horizontally so that the bottom rams 64, 66, 68 and blade 76 moves along the slots 22 located in the side walls 16, 18 of the base 12. As the bottom rams 64, 66, 68 move the blade 76, the blade 76, through the beveled steps 78, 80, 82, 84 dig into the well which is pushed into the u-shaped recessed portion 86. The force of the blade 76 against the recessed portion 86 causes the well to be cut.

The upper ramming member 50 and the u-shaped member 60 support the well as it is cut off. Once the well is cut off, the well is removed for the disposal the apparatus 10 can be transported through a crane to another well to repeat the function.

The discussion included in this patent is intended to serve as a basic description. The reader should be aware that the specific discussion may not explicitly describe all embodiments possible and alternatives that are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. An apparatus for cutting off a well comprising a substantially rectangular shaped base, said base further comprising a front face;

a rear face;

a first side face;

a second side face wherein said front face, said rear face, said first side face and said second side face combine to create an interior space that is to be placed around a well to be cut off;

a first pair of vertical supports attached to said front face;

a second pair of vertical supports attached to said rear face wherein said first pair of vertical supports and said second pair of vertical supports are connected through a first supporting side bar and a second supporting sidebar;

a third pair of vertical supports extending from said first side face and second side face at a position substantially midway across said first side face and said second side face;

a first supporting bar connecting said second pair of vertical supports;

a second supporting bar connecting said third pair of vertical supports;

a ramming member extending from said first supporting side bar wherein said ramming member is connected to said first supporting side bar at its proximate end and wherein said ramming member's distal end terminates in a u-shaped member;

one or more hydraulic rams attached to said rear face;

a blade attached to said one or more hydraulic rams; and a recessed portion attached to said front face into which said blade is moved through said one or more hydraulic rams.

2. The apparatus for cutting off a well as defined in claim 1 wherein said first side face and said second side face contains one or more horizontal slots that sit substantially parallel to each other.

3. The apparatus for cutting off a well as defined in claim 1 wherein said second pair of vertical supports contains apertures to aid in the movement thereof with a crane.

4. The apparatus for cutting off a well as defined in claim 1 wherein said third pair of vertical supports contains apertures to aid in the movement thereof with a crane.

5. The apparatus for cutting off a well as defined in claim 1 wherein said ramming member is connected to hydraulic lines.

6. The apparatus for cutting off a well as defined in claim 1 wherein said one or more hydraulic rams are connected to hydraulic lines.

7. The apparatus for cutting off a well as defined in claim 1 wherein said blade has one or more beveled steps.

8. The apparatus for cutting off a well as defined in claim 1 wherein said recessed portion is substantially u-shaped.

9. A method for cutting off a well comprising locating a defunct well;

placement of an apparatus around said defunct well, said apparatus further comprising a substantially rectangular shaped base, said base further comprising a front face;

a rear face;

a first side face;

a second side face wherein said front face, said rear face, said first side face and said second side face combine to create an interior space that is to be placed around a well to be cut off;

a first pair of vertical supports attached to said front face;

a second pair of vertical supports attached to said rear face wherein said first pair of vertical supports and said second pair of vertical supports are connected through a first supporting side bar and a second supporting sidebar;

a third pair of vertical supports extending from said first side face and second side face at a position substantially midway across said first side face and said second side face;

a first supporting bar connecting said second pair of vertical supports;

a second supporting bar connecting said third pair of vertical supports;

a ramming member extending from said first supporting side bar wherein said ramming member is connected to said first supporting side bar at its proximate end and wherein said ramming member's distal end terminates in a u-shaped member;

one or more hydraulic rams attached to said rear face;

a blade attached to said one or more hydraulic rams; and a recessed portion attached to said front face into which said blade is moved through said one or more hydraulic rams;

causing said one or more hydraulic rams and said ramming member to be moved from said rear face to said front face so that said well is held in place by said recessed portion and said ramming member while said blade cuts off the well; and removing said well.

10. The method for cutting off a well as defined in claim 9 wherein said first side face and said second side face contains one or more horizontal slots that sit substantially parallel to each other.

11. The method for cutting off a well as defined in claim 9 wherein said second pair of vertical supports contains apertures to aid in the movement thereof with a crane.

12. The method for cutting off a well as defined in claim 9 wherein said third pair of vertical supports contains apertures to aid in the movement thereof with a crane.

13. The method for cutting off a well as defined in claim 9 wherein said ramming member is connected to hydraulic lines.

14. The method for cutting off a well as defined in claim 9 wherein said one or more hydraulic rams are connected to hydraulic lines.

15. The method for cutting off a well as defined in claim 9 wherein said blade has one or more beveled steps.

16. The method for cutting off a well as defined in claim 9 wherein said recessed portion is substantially u-shaped.

* * * * *